US011229308B2

(12) United States Patent
Dillingham, Jr.

(10) Patent No.: US 11,229,308 B2
(45) Date of Patent: Jan. 25, 2022

(54) SELF DEFENSE INSTRUMENT AND KEY WITH SHARPENED TIP

(71) Applicant: Blase Patrick Dillingham, Jr., South Lake Tahoe, CA (US)

(72) Inventor: Blase Patrick Dillingham, Jr., South Lake Tahoe, CA (US)

( * ) Notice: Subject to any disclaimer, the term of this patent is extended or adjusted under 35 U.S.C. 154(b) by 0 days.

(21) Appl. No.: 15/837,213

(22) Filed: Dec. 11, 2017

(65) Prior Publication Data

US 2018/0202754 A1 Jul. 19, 2018

Related U.S. Application Data

(60) Provisional application No. 62/433,116, filed on Dec. 12, 2016.

(51) Int. Cl.

| | |
|---|---|
| ***A47G 29/10*** | (2006.01) |
| ***E05B 19/00*** | (2006.01) |
| ***F41B 15/08*** | (2006.01) |
| ***F41B 15/00*** | (2006.01) |
| ***E05B 19/04*** | (2006.01) |
| ***A44B 15/00*** | (2006.01) |

(52) U.S. Cl.

CPC ..... *A47G 29/10* (2013.01); *A44B 15/00* (2013.01); *E05B 19/00* (2013.01); *E05B 19/0082* (2013.01); *E05B 19/04* (2013.01); *F41B 15/00* (2013.01); *F41B 15/08* (2013.01)

(58) Field of Classification Search

CPC .. E05B 19/00; E05B 19/0005; E05B 19/0082; A47G 29/10; A44B 15/00; F41B 15/00; F41B 15/08

See application file for complete search history.

(56) References Cited

U.S. PATENT DOCUMENTS

| | | | | | |
|---|---|---|---|---|---|
| 2,448,969 | A * | 9/1948 | French | A44B 15/00 | 70/456 R |
| 4,160,369 | A * | 7/1979 | Pearson | A45C 11/32 | 463/47.4 |
| 4,475,367 | A * | 10/1984 | Raitto | A44B 15/005 | 70/456 R |
| 4,583,383 | A * | 4/1986 | Bosco | E05B 19/00 | 70/408 |
| 4,752,072 | A * | 6/1988 | Parsons | A44B 15/005 | 463/47.4 |
| 4,910,983 | A * | 3/1990 | Taylor | E05B 19/00 | 70/408 |
| 4,991,417 | A * | 2/1991 | Grecco | E05B 19/00 | 294/158 |
| 5,058,465 | A * | 10/1991 | Womack | B25B 3/00 | 294/158 |
| 5,181,605 | A * | 1/1993 | Bishop | E05B 19/24 | 70/408 |
| 5,207,082 | A * | 5/1993 | LeMaitre | E05B 19/00 | 70/408 |

(Continued)

*Primary Examiner* — Christopher J Boswell

(74) *Attorney, Agent, or Firm* — Lisa Foundation Patent Law Clinic—Arizona State University

(57) ABSTRACT

The present invention is a self-defense instrument comprised of an ergonomic key holder and a key with a sharpened tip that is retained within a slotted compartment defined within the key holder, said key holder further including opposite extending protrusions that extend generally perpendicularly away from the slotted compartment and that are configured to be graspable by the user's hand.

12 Claims, 12 Drawing Sheets

(56) References Cited

U.S. PATENT DOCUMENTS

| | | | | | |
|---|---|---|---|---|---|
| D352,339 | S * | 11/1994 | McGowan | F41B 15/027 | D22/117 |
| 5,621,936 | A * | 4/1997 | Penaligon | A44B 15/005 | 206/234 |
| 5,667,441 | A * | 9/1997 | Parsons | F41B 15/027 | 463/47.7 |
| 5,737,951 | A * | 4/1998 | Krass | A45C 11/324 | 70/408 |
| 6,164,102 | A * | 12/2000 | Gapco | E05B 19/00 | 70/408 |
| 6,598,438 | B2 * | 7/2003 | Ashby | E05B 19/00 | 70/408 |
| 6,928,845 | B2 * | 8/2005 | Howard | E05B 19/24 | 70/408 |
| 7,171,831 | B2 * | 2/2007 | Matthews | A44B 15/005 | 7/151 |
| 9,145,711 | B1 * | 9/2015 | Burton | E05B 19/00 | |
| 2009/0071210 | A1 * | 3/2009 | Teague | A62B 3/005 | 70/405 |
| 2012/0088587 | A1 * | 4/2012 | Zaccari | F41B 15/00 | 463/47.4 |
| 2020/0011635 | A1 * | 1/2020 | Hiroshi Dean | A44B 15/00 | |

* cited by examiner

SELF DEFENSE INSTRUMENT AND KEY WITH SHARPENED TIP

CROSS-REFERENCE TO RELATED APPLICATION

This application claims the benefit of and priority to U.S. Provisional Patent Application No. 62/433,116 filed on Dec. 12, 2016, which is incorporated by reference herein in its entirety.

FIELD OF THE INVENTION

Aspects, of this document relate generally to hand-held utility tool holders that allow a user to hold a utility tool in an ergonomic fashion for self-defense.

BACKGROUND OF THE INVENTION

In particular, conventional utility tools, such as, keys, are ergonomically hard to hold between the fingers in a manner that would allow for use to fend off an attacker. There are tools that help a user hold a key or a pocket tool. However, these holders do not allow a user to hold the tool in an ergonomic fashion while also retaining the intended functionality of the utility tool. Many ergonomic key holders intended for self-defense do contain functioning keys.

SUMMARY OF THE INVENTION

The present invention comprises apparatus for and a method of holding a utility tool by hand for use in self-defense using a holder. The holder comprises a finger grip contoured to fit between the user's fingers, an opening on the bottom end of the holder in fluid communication with a channel that allows for a utility tool to be inserted into the holder, and a locking nub located in the channel to lock the tool in place in the holder. The combination of the finger grip, opening on the bottom end of the holder in fluid communication with a channel and locking nubs inside the channel allow a user to hold a utility tool ergonomically for self-defense purposes. This combination also allows the utility tool to maintain its intended functionality.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
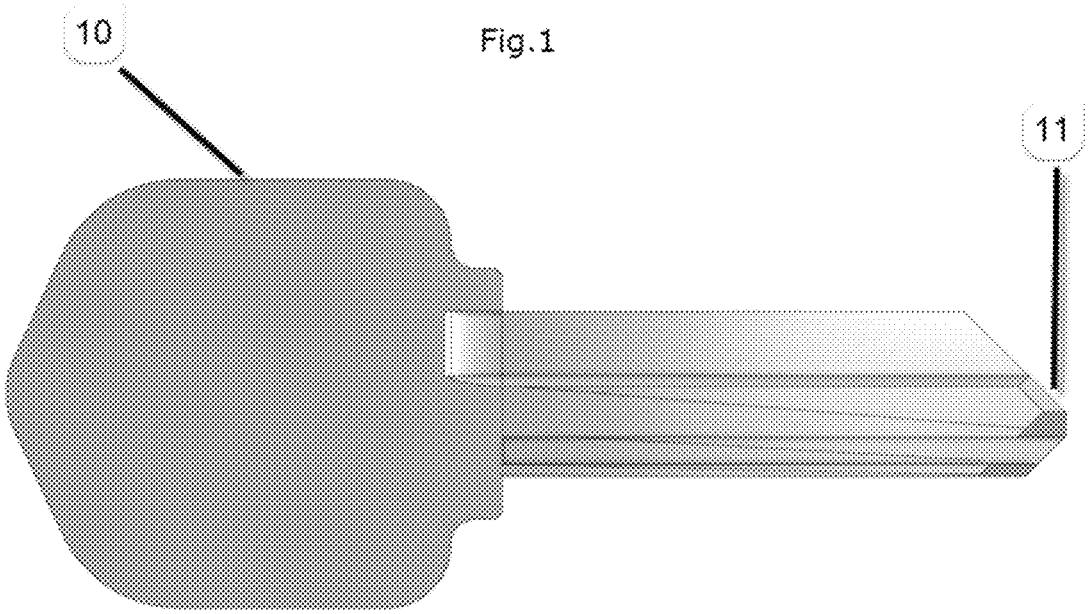
FIG. 1 is a perspective view of one of the preferred embodiments of tools compatible, with the present invention, wherein the tool is a key blank with a sharpened tip.
Figure 2:
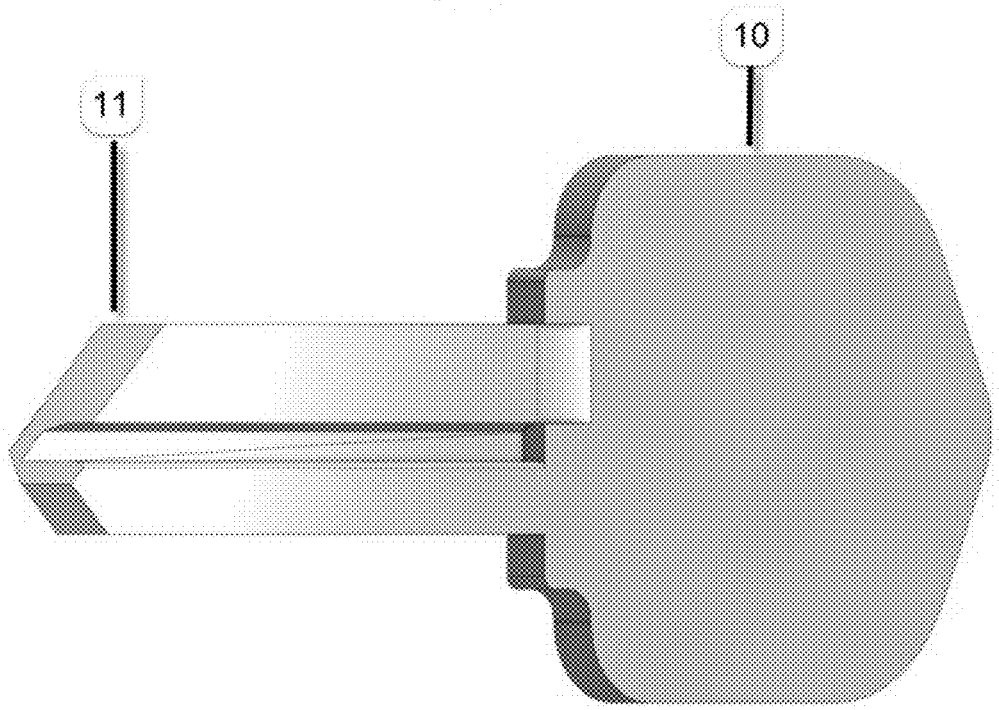
FIG. 2 is a planar side view of one of the preferred embodiments of tools compatible with the present invention, wherein the tool is a key blank with a sharpened tip.
Figure 3:
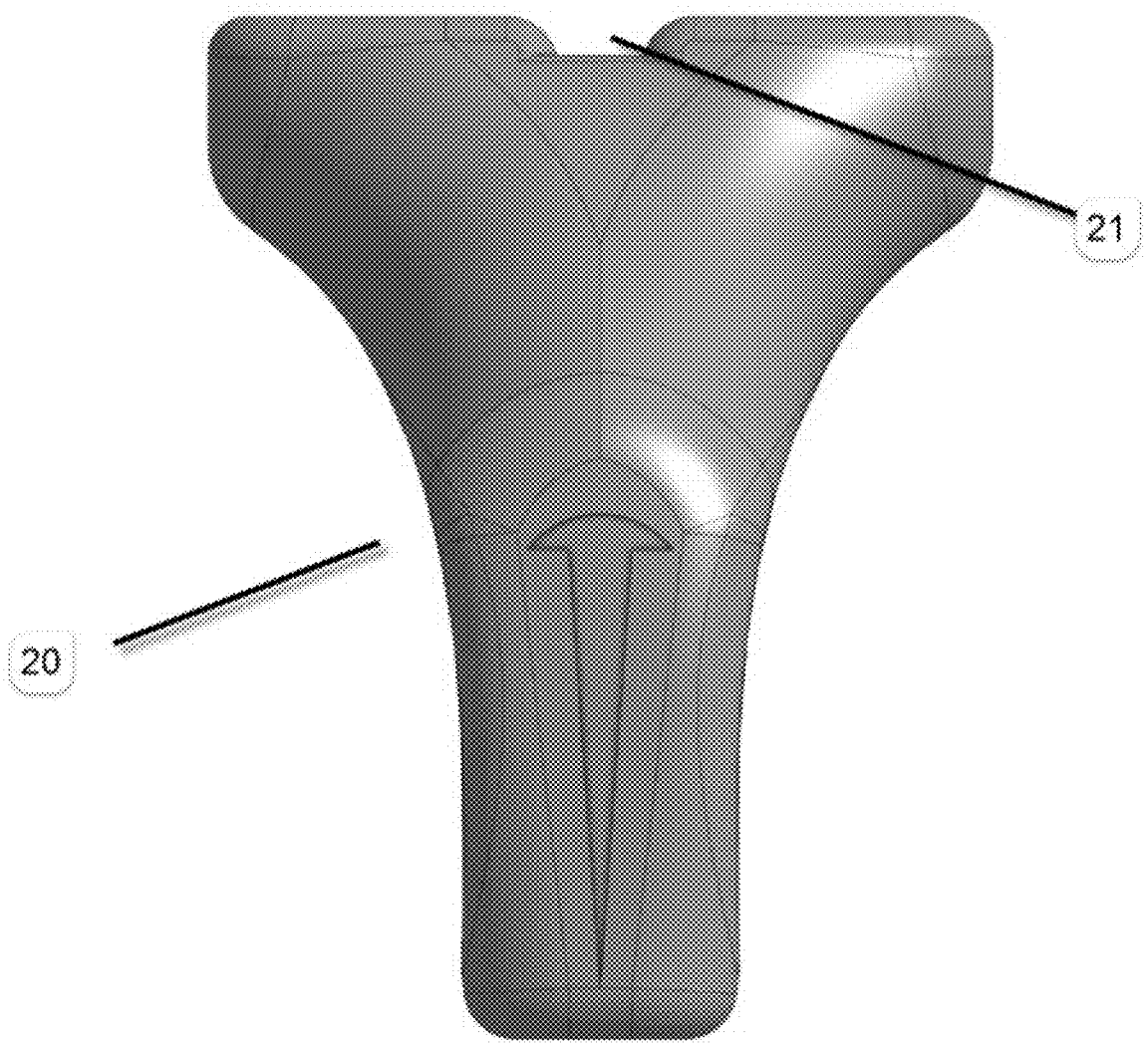
FIG. 3 is a planar side view of the of the present invention.
Figure 4:
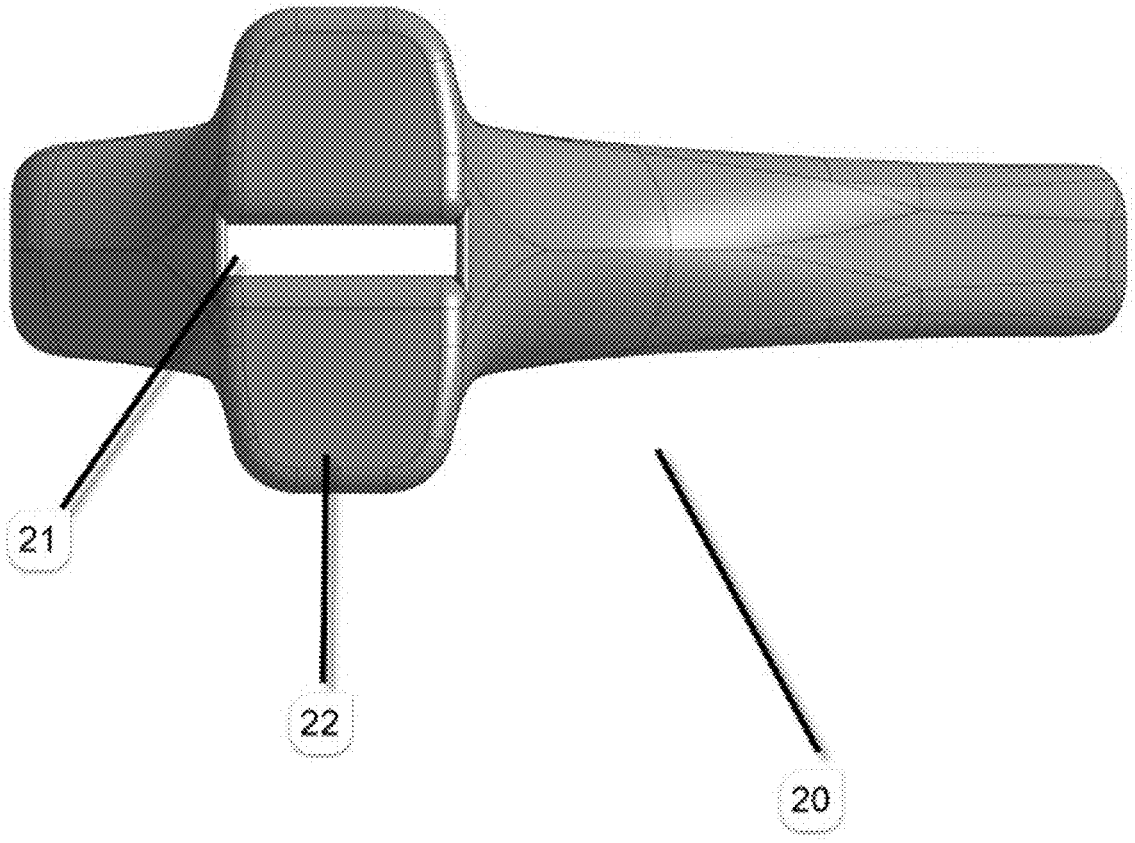
FIG. 4 is a planar top view of the present invention.
Figure 5:
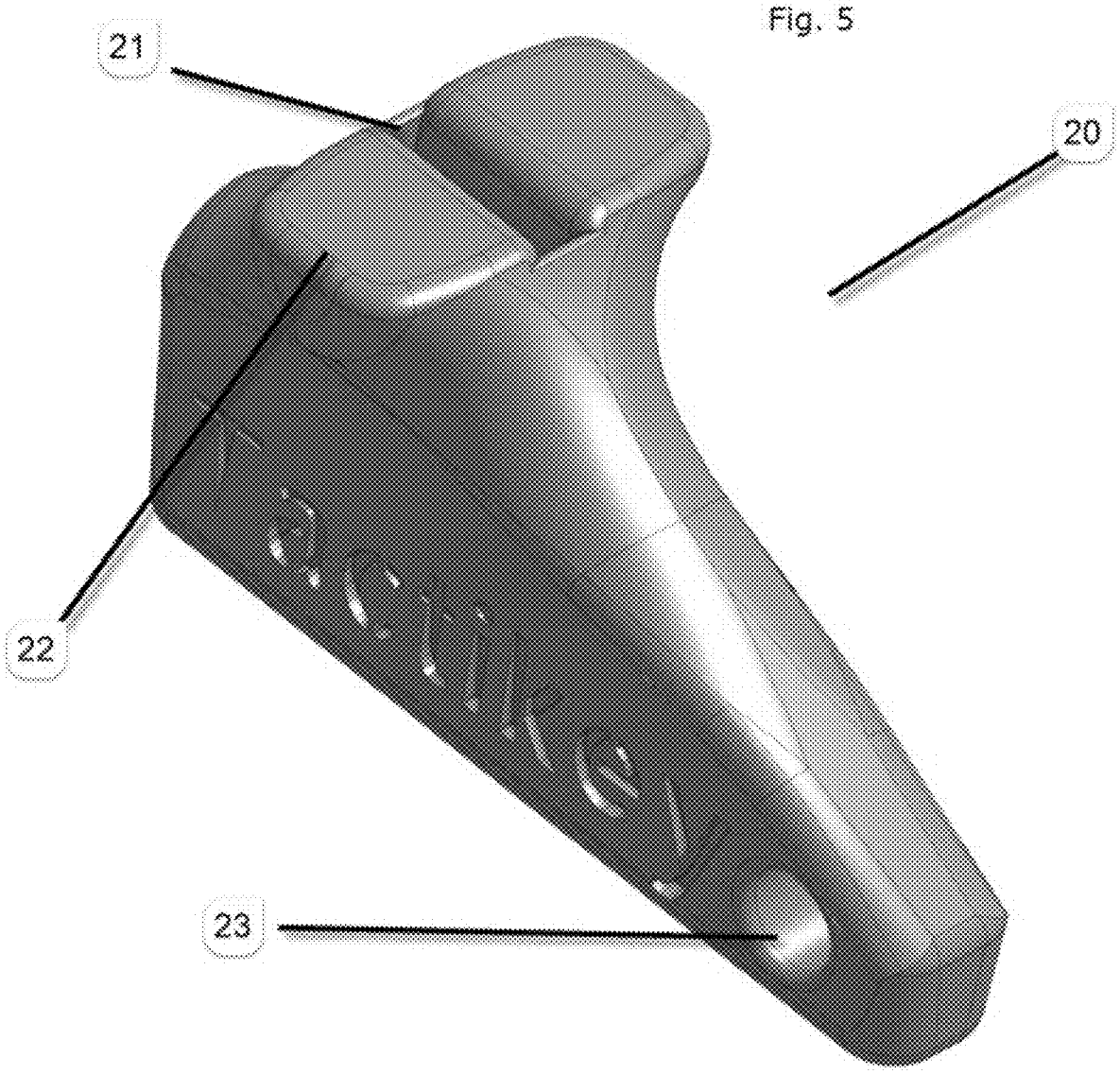
FIG. 5 is a perspective view of the top end of the present invention.
Figure 6:
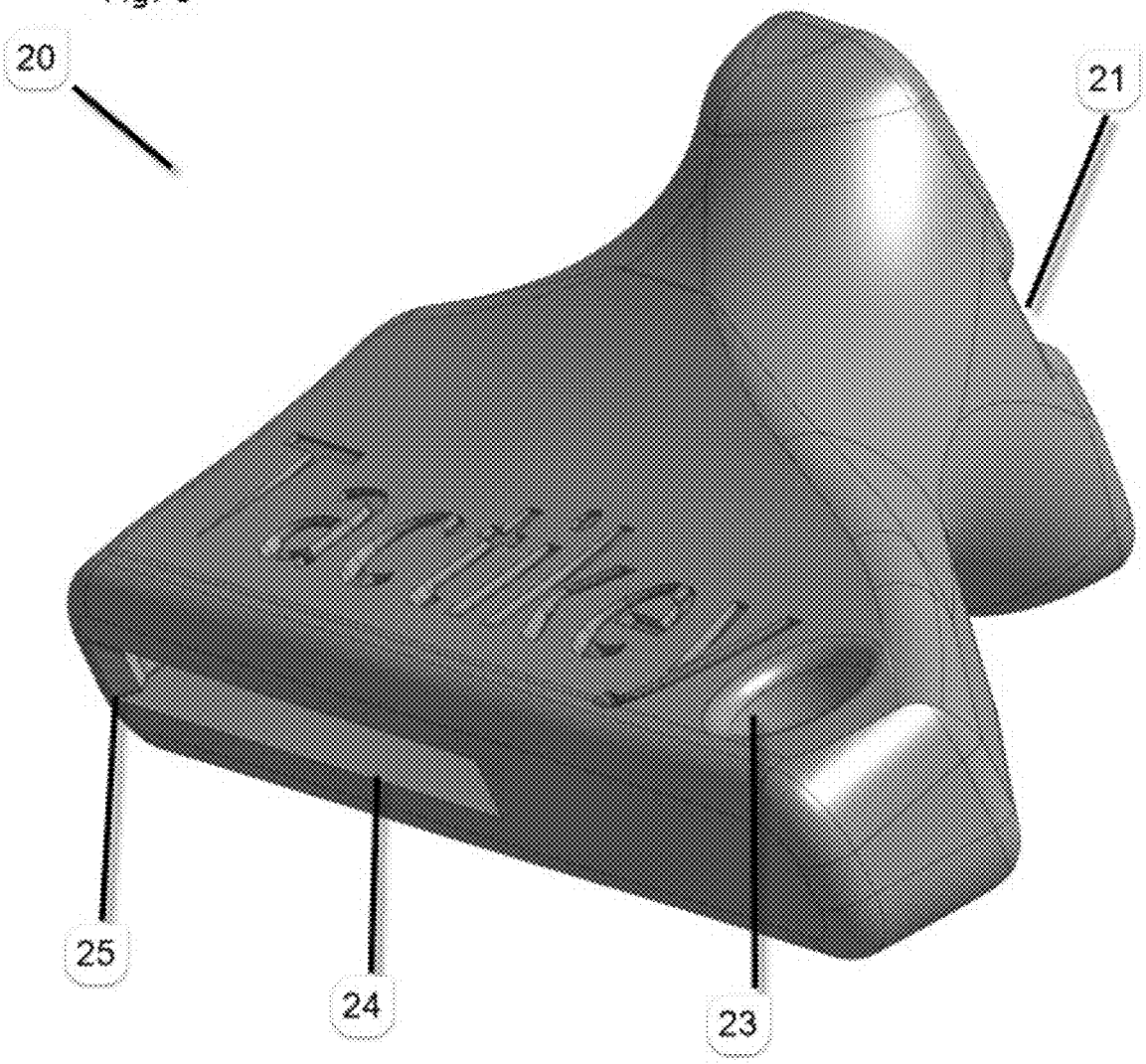
FIG. 6 is a perspective view of the bottom end of the present invention.
Figure 7:
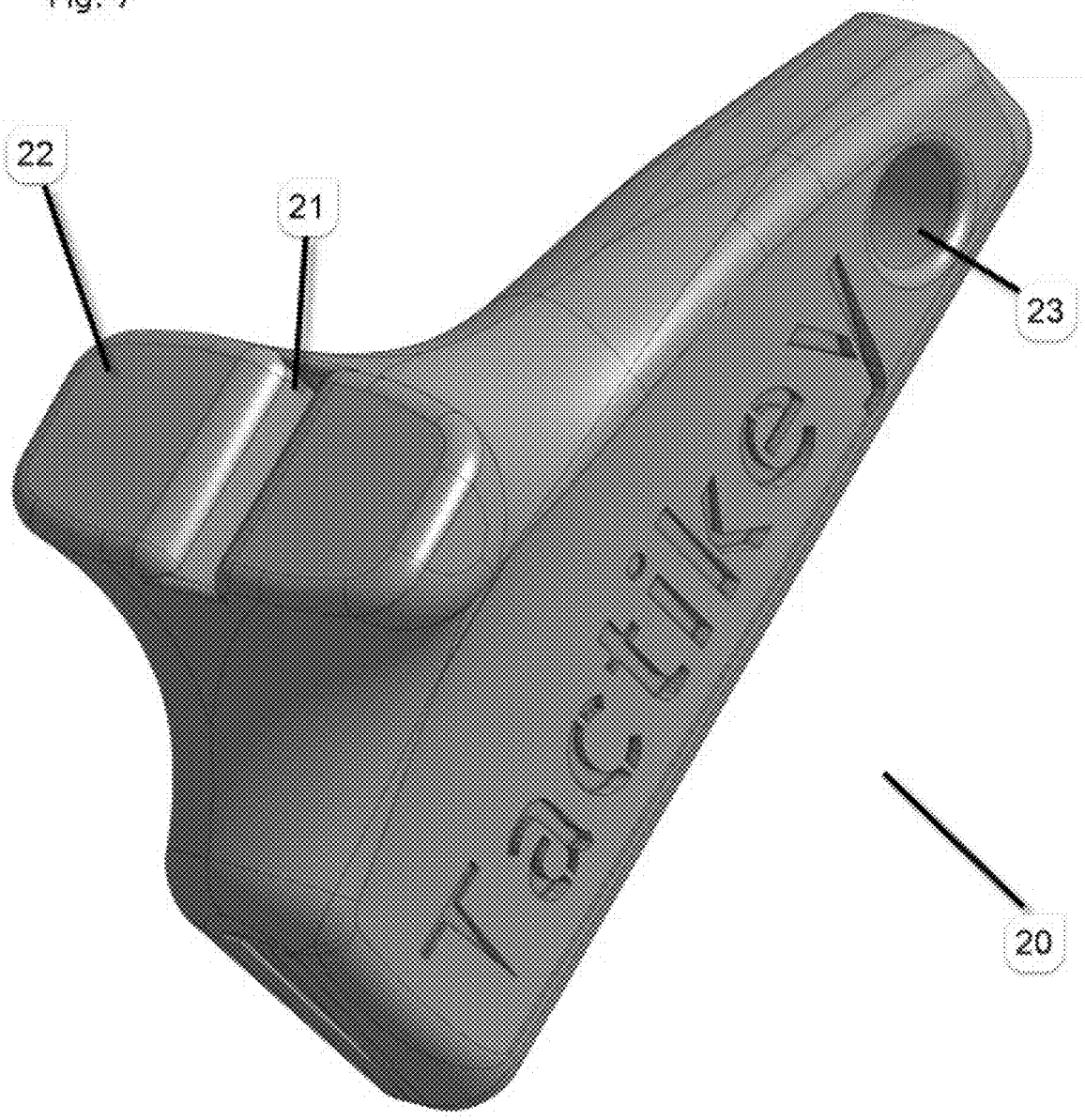
FIG. 7 is a perspective view of the top end of the present invention.
Figure 8:
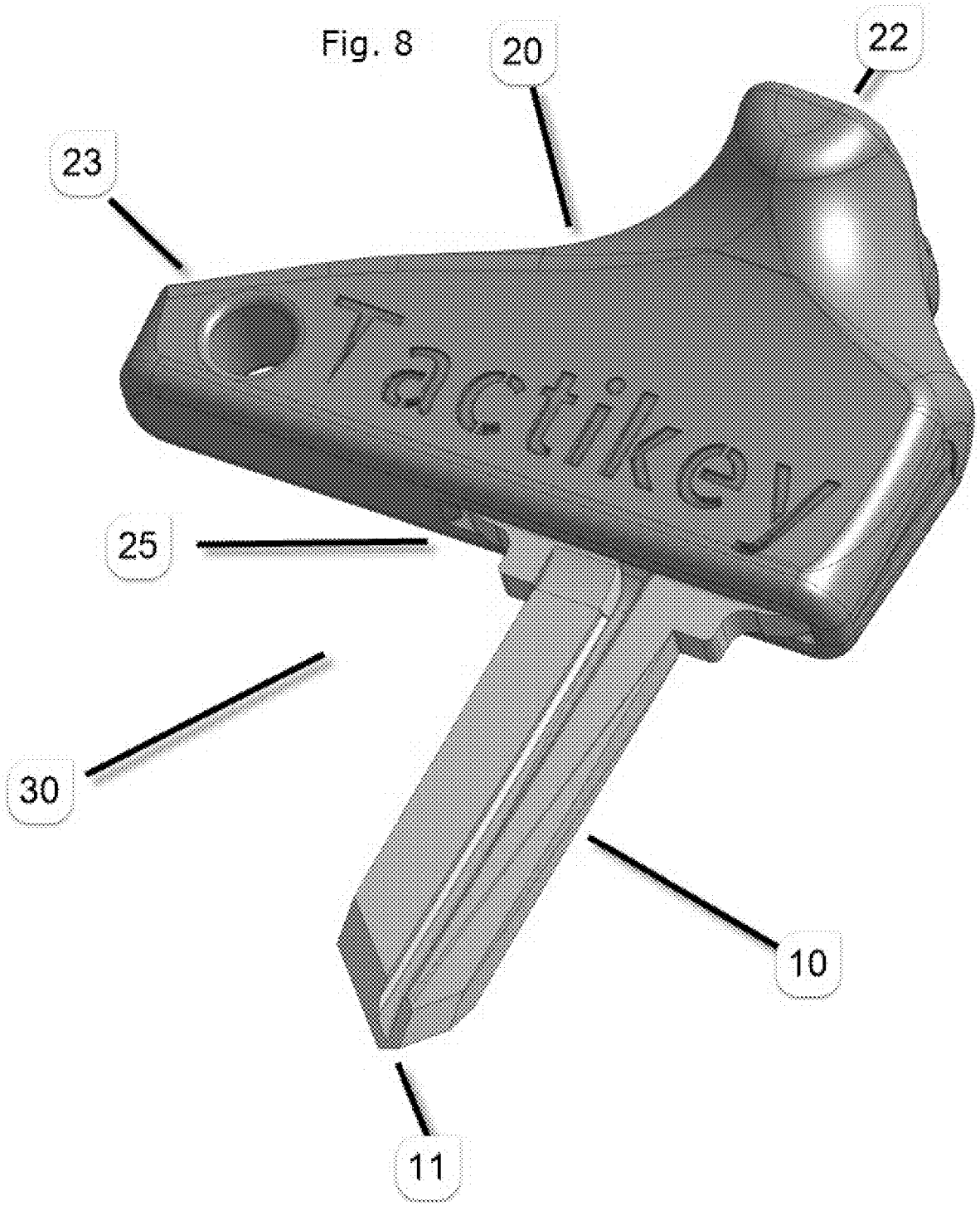
FIG. 8 is a perspective view of one of the preferred embodiments of the present invention, in which the key blank has been received by the holder.
Figure 9:
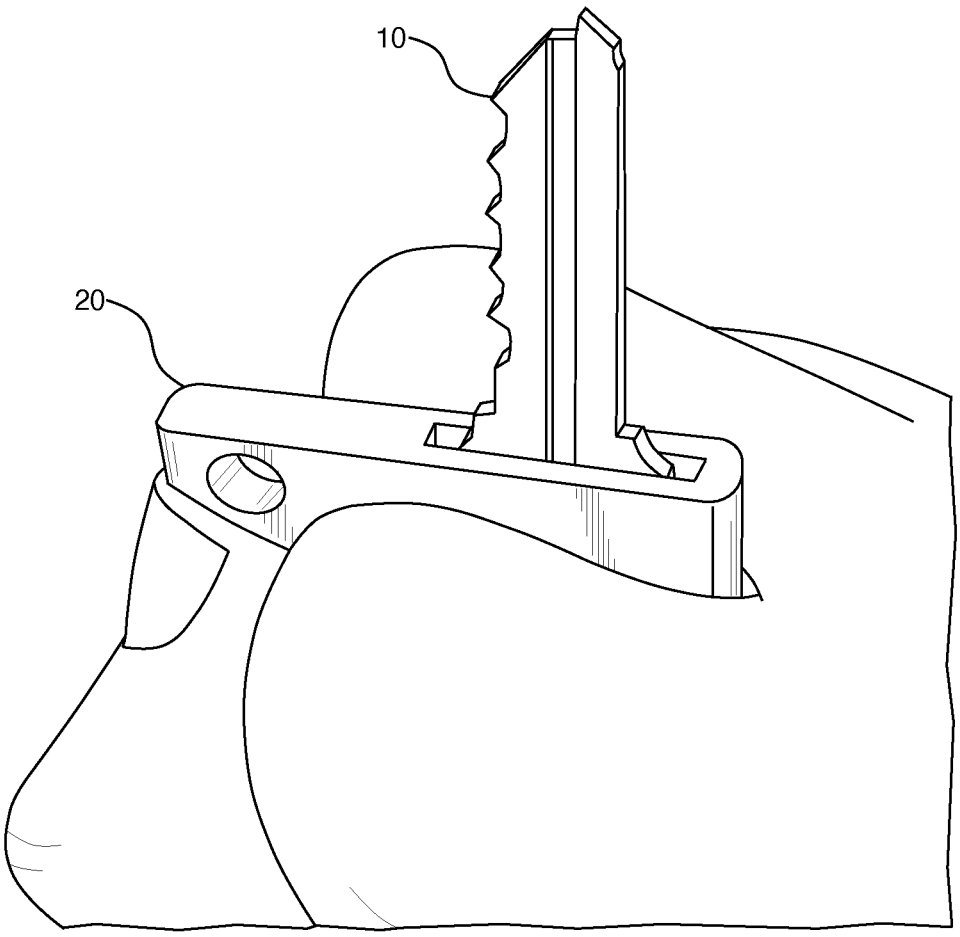
FIG. 9 is a perspective view of the bottom end of one of the preferred embodiments of the present invention, in which the key blank having been received by the holder is being held in a user's closed hand.
Figure 10:
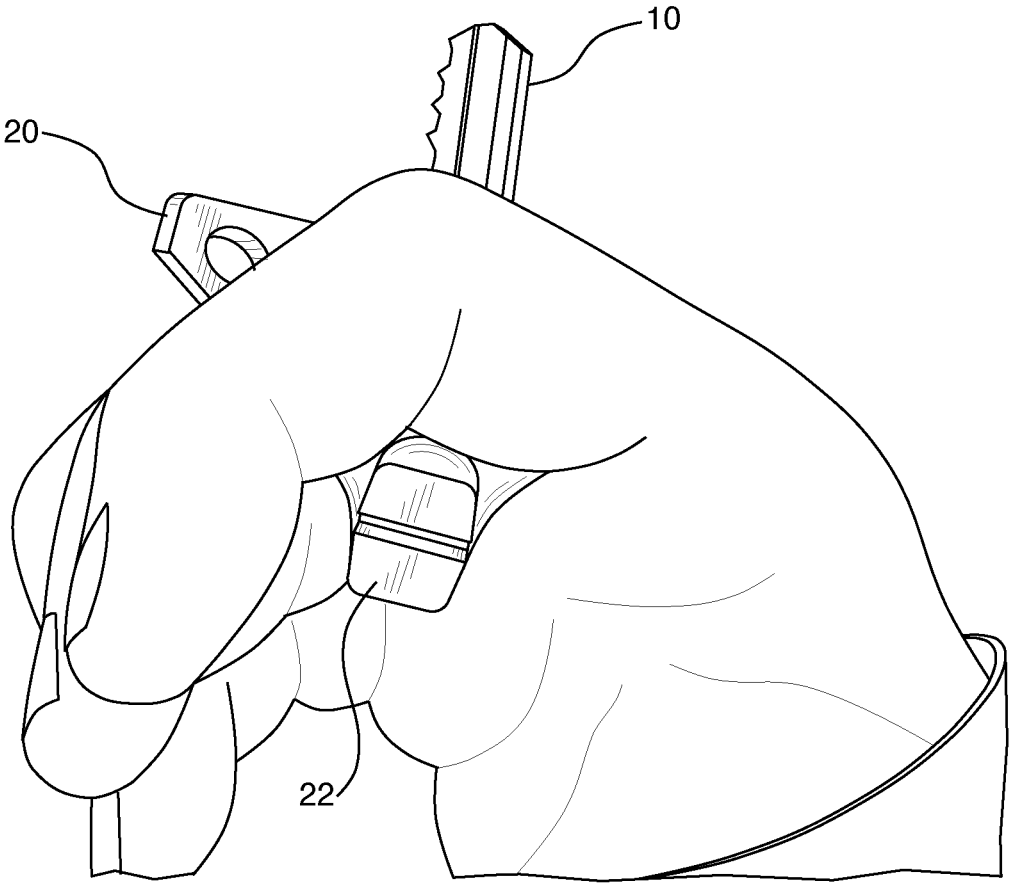
FIG. 10 is a perspective view of the top end of one of the preferred embodiments of the present invention, in which the key blank having been received by the holder is being held in a user's partially open hand.
Figure 11:
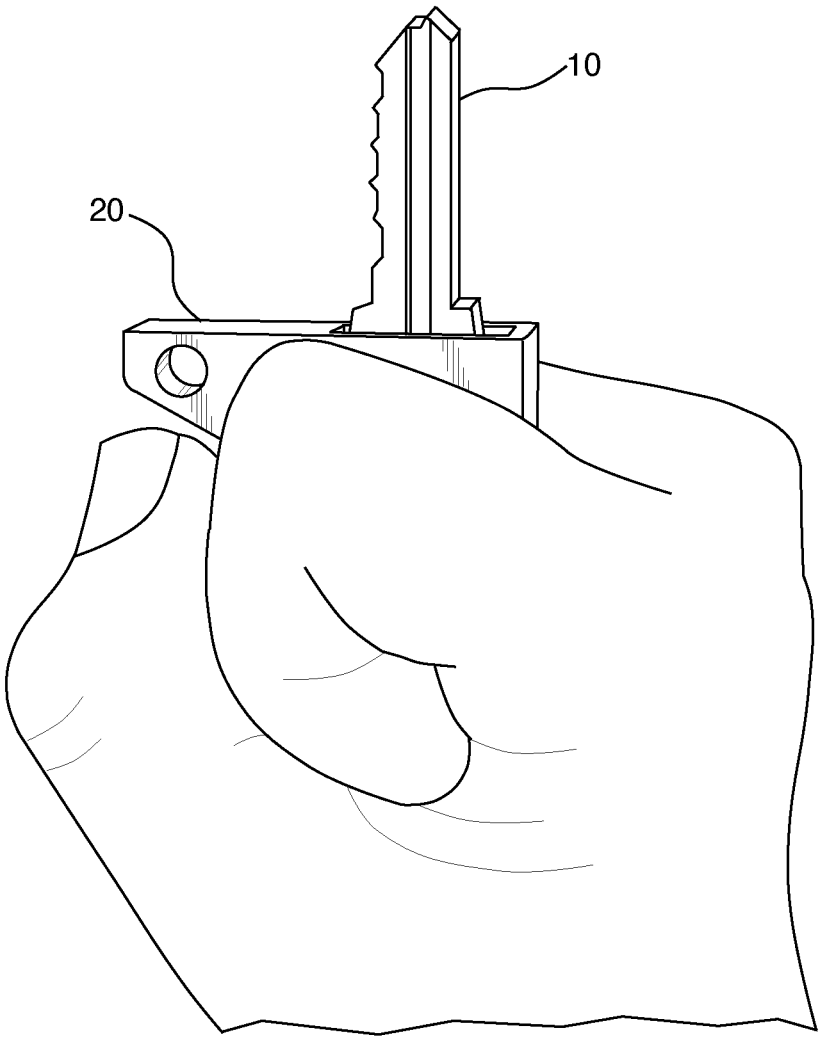
FIG. 11 is a perspective view of the side end of one of the preferred embodiments of the present invention, in which the key blank having been received by the holder is being held in a user's partially open hand.

As can be seen in FIG. 4, the two opposed finger-receiving convex sides of the finger grip 22 extend outwards from the main body of the holder 20. As can be seen in FIG. 5, each of the two opposed finger-receiving convex sides of the finger grip 22 extend outwards from the main body of the holder 20 proximal the top side of the holder 20. Each finger-receiving convex side of the finger grip 22 convexly contour from their most extended point into the main body of the holder towards the bottom end of the holder. The convex nature of the finger grip 22 extending from the main body of the holder 20 can be seen in FIG. 6. As can be seen in FIG. 8, the two concave sides of the finger grip 22 can be seen. Each convex side of the finger grip 22 extends outwards from the main body of the holder 20 and proximal the outer most point of extension, the side of the finger grip 22 is concave. Towards the top side of the holder 20, each concave side of the finger grip 22 increases in width. Towards the bottom side of the holder 20, each concave side of the finger grip 22 decreases in width. As seen in FIG. 10, the two concave sides and two opposed finger-receiving convex sides of the finger grip 22 allow a user to grip the holder 20 in an ergonomic fashion.

Figure 12:
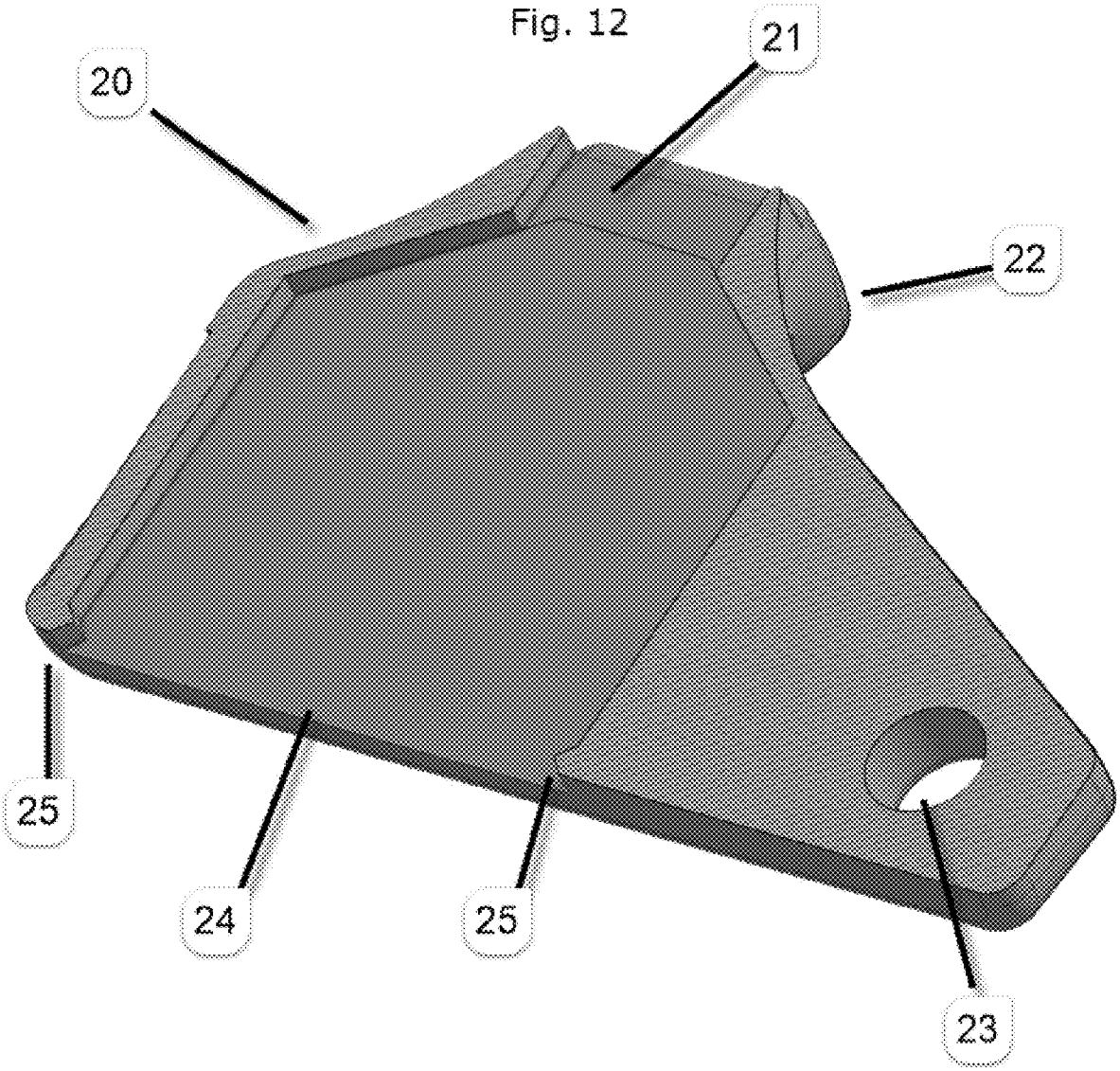
FIG. 12 is a sectional view of the invention showing the opening in fluid communication with a channel and a locking nub in the channel.

As can be seen in FIG. 12, the holder 20 comprises an opening 24 in the bottom end of the holder 20, that is in fluid communication with a channel 21 that extends through the top of the holder 20. In the preferred embodiment of the invention, the holder comprises two locking nubs 25 that are located inside the channel 21. In the preferred embodiment, the locking nub 25 is triangular. As seen in FIGS. 12 and 5, in one embodiment, the holder may comprise a hole 23 that may be used to attach the holder 20 to another object, such as a keychain.

As seen in FIGS. 1, 2, 6, and 8, one embodiment of the present invention allows for a tool that is a key 10 with a sharpened tip 11 to be slidably inserted into the opening 24 of the holder 20. As seen by FIG. 8, a head of the key 11 is inside the holder 20 and is locked in place by a locking nub 25. This allows for the key to remain locked inside the holder when a user is holding onto the holder.

The key with sharpened tip 10, can be constructed out of titanium, brass, steel, aluminum or any other sufficiently rigid and strong material such as high-strength plastic or metal. The key holder 20, can be constructed out of any kind of plastic, metal or any other sufficiently rigid and strong material such as high-strength plastic or metal.

The advantages of the present invention include, without limitation, that it is portable and exceedingly easy to transport. It can allow the user to fend off an attacker similar to a knife. It is easy to hold and it is relatively small and lightweight. Further, the devices generally will store a house key on a keychain in a safe and efficient way. Further, the devices can provide a feeling of security while carrying around an object that everyone is always carrying around with them all the time.

The preferred embodiment of the present invention allows for a key 11 to be inserted into the holder 20. The invention is not limited to this embodiment. In another embodiment, the holder may be configured to receive a different utility device.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim the following:

1. A self-defense instrument, comprising:

a holder comprising a unitary body, the holder further comprising:

a finger grip comprising:

a left concave side;

a right concave side;

a left finger-receiving convex side;

a right finger receiving convex side, wherein:

the left concave side, the right concave side, the left finger-receiving convex side, and a right finger-receiving convex side are each proximal a top end of the holder;

a first normal vector of the left finger-receiving convex side a second normal vector of the right finger-receiving convex side, a third normal vector of the left concave side and the fourth normal vector of the right concave side are each pointed away from a channel that extends to the top end of the holder;

the left finger-receiving convex side is smooth and continuous relative to the left concave side; and the right finger-receiving convex side is smooth and continuous relative to the right concave side;

a bottom end of the holder comprising an opening in fluid communication with the channel; and a locking nub within the channel, proximal to an opening at the bottom end of the holder, and proximal to a base of a head of an instrument.

2. The self-defense instrument of claim 1, wherein the opening is configured to slidably receive a head of the key.

3. The self-defense instrument of claim 2, wherein the locking nub is configured to lock the head of the key in place.

4. The self-defense instrument of claim 3, wherein the opening and the locking nub are configured to receive the head of at least one key.

5. The self-defense instrument of claim 1, wherein the holder is comprised of a plastic material.

6. The self-defense instrument of claim 1, wherein the holder is comprised of a metal material.

7. A method of holding a self-defense instrument, comprising: holding a holder comprising a unitary body, holding the holder further comprising:

gripping a finger grip that comprises:

a left concave side;

a right concave side;

a left finger-receiving convex side; and a right finger receiving convex side, wherein:

the left concave side, the right concave side, the left finger-receiving convex side, and a right finger-receiving convex side are each proximal a top end of the holder;

a first normal vector of the left finger-receiving convex side, a second normal vector of the right finger-receiving convex side, a third normal vector of the left concave side, and the fourth normal vector of the right concave side are each pointed away from a channel that extends to the top end of the holder;

the left finger-receiving convex side is smooth and continuous relative to the left concave side; and the right finger-receiving convex side is smooth and continuous relative to the right concave side, receiving an instrument in a bottom end of the holder that comprises an opening in fluid communication with a channel that extends to the top end of the holder; and locking the instrument inside the holder using a locking nub within the channel, proximal to the opening in the bottom end of the holder proximal to the base of the instrument.

8. The method of claim 7, wherein the opening slidably receives a head of a key.

9. The method of claim 8, wherein the locking nub locks the head of the key in place.

10. The method of claim 9, further comprising receiving, by the opening and the locking nub, the head of at least one key.

11. The method of claim 7, further comprising unlocking the instrument from the locking nub by exerting a force upon the instrument through the channel that extends to the top end of the holder.

12. The method of claim 11, further comprising slidably discharging the instrument from the holder.

* * * * *